United States Patent [19]

Gunn et al.

[11] Patent Number: 4,469,113

[45] Date of Patent: Sep. 4, 1984

[54] COIN PROCESSING APPARATUS

[75] Inventors: William L. Gunn, Atlanta; Thomas Preacher, Jr., Marietta, both of Ga.

[73] Assignee: Brink's Inc., Darien, Conn.

[21] Appl. No.: 471,359

[22] Filed: Mar. 2, 1983

[51] Int. Cl.[3] ..... G07D 3/06

[52] U.S. Cl. ..... 133/3 E; 221/211; 251/DIG. 3

[58] Field of Search ..... 133/3 R, 3 A, 3 E, 8 R; 221/211, 113; 209/643; 251/DIG. 3, 320, 321, 322, 323, 278

[56] References Cited

U.S. PATENT DOCUMENTS 2,645,062 7/1953 Senesky ..... 251/323 X 3,707,244 12/1972 Hull et al. ..... 133/8 R

*Primary Examiner*—Stanley H. Tollberg

*Attorney, Agent, or Firm*—Frank J. Thompson

[57] ABSTRACT

An improved coin processing apparatus is described. The apparatus includes a coin sorting arrangement having an adjustable baffle means which provides a constriction to air flow for establishing coin restraining pressures in a chamber of the apparatus. The baffle means includes a resilient sealing body having a cross-sectional configuration which can be adjustably varied. Expansion of the cross-section reduces the size of the constriction and increase a pressure gradiant between upper and lower sectors of the chamber. Alternatively, contraction of the cross-section enlarges the size of the constriction and reduces the pressure gradiant between upper and lower sectors of the chamber.

10 Claims, 4 Drawing Figures

COIN PROCESSING APPARATUS

BACKGROUND

1. Field of the Invention

This invention relates to apparatus for processing coins. The invention relates more particularly to an improved arrangement for establishing a reduced pressure in a chamber of a coin processing apparatus.

2. Description of the Prior Art

A coin processing apparatus having a sorting drum arrangement is known wherein an apertured, sorting drum rotates in a stationary housing. Coins being processed are deposited in the rotating drum, and, after tumbling in the drum near a lower location of the housing, seat themselves in the drum apertures. A reduced pressure in an adjacent chamber between the housing and the drum establishes a restraining force on the seated coins. This force maintains the seated coins in the apertures as they are rotatably transported by the drum from a lower location to an elevated station in the housing. The coins are then automatically transferred to a coin receptacle at the elevated station for processing. An apparatus of this type is disclosed and is claimed in U.S. Pat. No. 3,707,244 which is assigned to the assignee of this invention.

Coins being transported by the drum experience varying forces during transport. Initially, as the coins are deposited in the drum, they tumble and become seated in drum apertures. Gravitational force operates to restrain coins in apertures thus seated. However, as the drum rotates, the spatial attitude of the coin and its seat changes until finally they are rotated to an overhead station at which location the gravitational force, now acting to dislode a seated coin from an aperture is greatest. A restraining vacuum force which is applied to a seated coin should therefore be of sufficient magnitude to maintain a coin seated at its different attitudes during transport.

Although it may initially appear that the application of a uniform, relatively high vacuum at both elevated and lower housing locations would, in general, provide the desired coin restraint, in practice this is found not to be the case. The seating characteristic of the coin in an aperture must also be considered and this factor renders it preferable to establish a relatively lower vacuum force on the seated coin at lower housing locations. A relatively high vacuum at a lower housing location is accompanied by increased air leakage about a seated coin. At times, this leakage is sufficiently large to undesirably cause a second coin to be simultaneously restrained and to be transported in piggyback fashion with the seated coin. To avoid this potential problem, the vacuum restraining force is preferably relatively low at lower housing locations and increases in magnitude as the coin rotates from the lower housing location to an upper location. For example, the vacuum established may range between about 1 to 2 inches of water at lower housing locations to between about 8 to 9 inches of water in the vicinity of upper housing locations. Moreover, while coins of different size having different surface areas should theoretically be restrained under the same vacuum, in practice it is also found that coins of relatively larger area require a relatively larger vacuum restraining force. As a result, pressures established in the apparatus to restrain one size coin will not under all circumstances be sufficient to restrain relatively larger size coins. Consequently, established pressures can not generally be used interchangeabely with coins of different size and vacuum readjustments may be necessary when processing coins of different sizes.

The aforementioned differential pressure requirements have been satisfied in part by the use of a stationary baffle plate. This plate is positioned in the chamber and establishes a constriction therein which separates the chamber into a relatively low pressure sector and a relatively higher pressure sector. In view of the desired differential pressures, the positioning of the baffle in the chamber is important and should be accomplished with a relatively high degree of care and accuracy. This need to carefully locate a stationary baffle plate imposes constraints on the design of the apparatus and thus increases the cost of fabrication and the intial set up of the apparatus. Moreover, in view of the processing of coins of different sizes and other variations encountered in the operation of the apparatus which result in pressure changes, e.g., variations in the source vacuum, variations in the dimensions of manufactured parts with wear, etc. the stationary baffle must at times be relocated in order to com- pensate for these factors. Relocation of the stationary baffle plate, however, has in the past required disassembly of the apparatus and is therefore relatively time consuming and expensive.

SUMMARY OF THE INVENTION

Accordingly, it is an object of this invention to provide an improved coin processing apparatus.

Another object of the invention is to provide an improved arrangement for establishing differential pressures in a chamber for restraining coins being transported by a drum of a coin processing apparatus.

Another object of the invention is to provide a means for readily adjusting pressure differentials in a chamber of a coin processing apparatus.

A further object of the invention is to provide adjustable means for simplifying changes in pressure differentials in a chamber of a coin processing apparatus without the need to disassemble the apparatus.

In accordance with the general features of this invention, a coin processing apparatus includes a coin sorting arrangement having a stationary housing and a rotatably-mounted, sorting drum positioned in the housing for rotation therein. The drum includes a plurality of apertures formed therein for receiving, seating, and transporting coins from a location adjacent the lower housing to an upper station of the housing. A chamber is formed between the drum and housing. A means is provided for establishing a reduced pressure in the chamber which causes application of a restraining force to coins seated in the apertures of the drum. A baffle means is positioned in the chamber and extends along the length of the housing. The baffle means forms a constriction with the rotating drum body in the chamber which separates the chamber into upper and lower sectors and creates a pressure gradiant in the chamber. The baffle means has a cross-sectional configuration which can be adjustably varied to expand to thus reduce the size of the constriction and thereby increase the pressure gradiant between upper and lower sectors of the chamber. Alternatively, it can be adjusted to contract, to thus enlarge the size of the constriction and to reduce the pressure gradiant between upper and lower sectors of the chamber. The baffle means includes means for adjustably varying its cross-sectional configuration from a location outside of the housing.

In a preferred embodiment, the baffle means includes an elongated baffle body formed of a material which is folded to provide a resilient U-shaped, cross-sectional configuration having first and second leg segments. One leg abuts against and forms an air seal with an inner wall of the housing. The adjusting means is coupled to the baffle for controlling movement of the second leg segment. Spacing between leg segments of the U-shaped body can thereby be adjusted to vary the baffle body cross-sectional configuration from a generally U-shaped contracted configuration to a generally U-shaped expanded configuration. The size of the restriction in the chamber is thereby respectively enlarged and reduced. With this arrangement, the size of the constriction in the chamber is varied to provide desired pressures for the coin processing apparatus upon initial set up of the apparatus and subsequently to compensate for variations occurring as a result of use and wear. The adjustments are advantageously made from outside the housing. In view of the adjustable characteristics of the baffle means, it can be conveniently positioned at different locations in the chamber.

BRIEF DESCRIPTION OF THE DRAWINGS

These and other objects and features of the invention will become apparent with reference to the following specification and to the drawings wherein.

DETAILED DESCRIPTION

Figure 1:
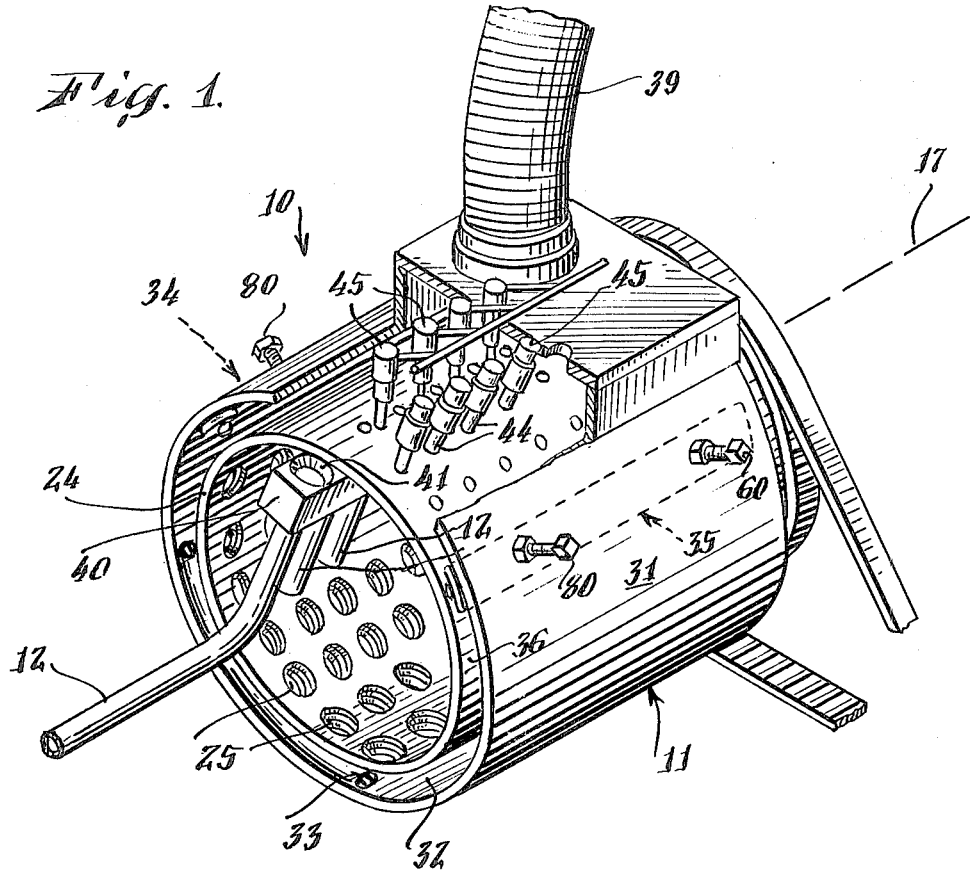
FIG. 1 is a fragmentary, perspective, partly broken away view of a coin sorting arrangement in a coin processing apparatus constructed in accordance with features of this invention.

Referring now to the drawings, FIG. 1 illustrates a coin processing apparatus 10 having a sorting drum arrangement 11. The term coin as used in this specification and claims is understood to include tokens and other similar disc-shaped objects. A detailed description of other components of the apparatus is given in U.S. Pat. No. 3,707,244, the disclosure of which is hereby incorporated herein by reference.

Figure 2:
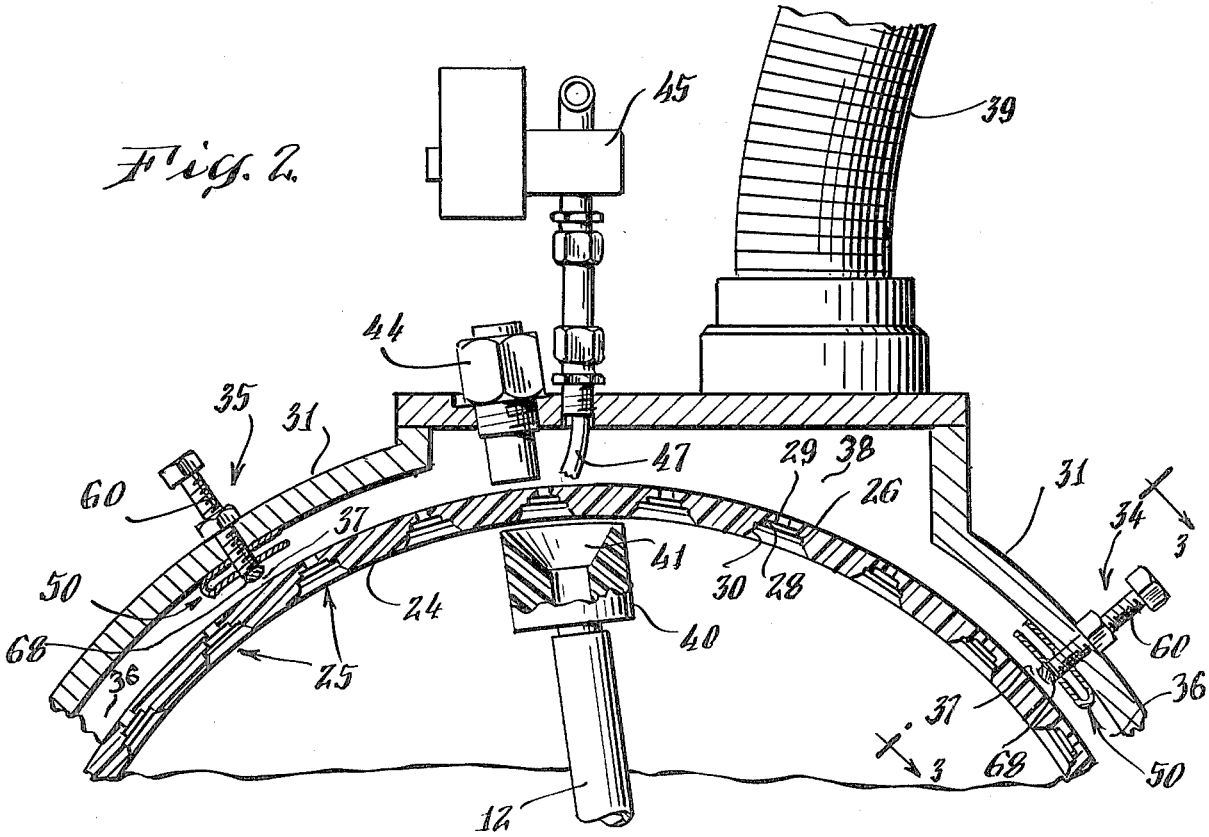
FIG. 2 is an enlarged, fragmentary view of a part of the apparatus of FIG. 1 illustrating an elevated station of a housing of the apparatus.

The sorting drum arrangement 11 includes a sorting drum or cylinder 24 fabricated of a non-conducting material, such as nylon, teflon or any of the conventional dielectric materials and is positioned with its longitudianl axis 17 disposed in an approximately horizontal attitude, and which is rotatable about its longitudinal axis. Sorting drum 24 includes a lattice or plurality of coin receiving recesses 25 in the internal surface of its wall. Recesses 25 extend along the length of and about the circumference of sorting drum 24, with the recesses being placed in annular alignment about the circumference of the drum. As is best illustrated in FIG. 2, coin receiving recesses 25 are substantially identical in shape and each includes an outer bore 26, an inner counter bore 28, an aperture 29 and a tapered or scalloped surface 30. Outer and inner bores 26 and 28 and apertures 29 for each recess 25 are disposed concentrically with respect to each other. Outer bores 26 are of a diameter and depth which correspond to the diameter and thickness of the coins which are to to be received in the coin receiving recesses. Inner counter bore 28 is slightly smaller than the smallest standard coin normally used in the coin currency being processed, so that the smallest coins will not enter inner counter bore 28.

Sorting drum arrangement 11 also includes a housing 31 which surrounds sorting drum 24. An annular air flow chamber 32 is defined between housing 31 and sorting drum 24 and by 0 rings 33 disposed at opposite ends of the housing. For purposes of clarity in the drawing, only one 0 ring 33 is illustrated. A baffle means 34 and 35 is provided and extends along the length of housing 31 and projects inwardly toward sorting drum 24 and with the rotating drum body forms a constriction 37 to air flow in the chamber. Baffle means 34 and 35 separate annular air flow chamber 32 into a first sector 36 below baffle means 34 and 35 and a second sector 38 generally above sorting drum 24. An opening is defined in the upper portion of housing 31, and an air exhaust conduit 39 is connected to the opening. A vacuum pump, not illustrated, is coupled to conduit 39 and functions to draw air from annular air flow chamber 32 and then through exhaust conduit 39. Baffle means 34 and 35 establish a lower pressure zone within second sector 38 of annular air flow chamber 32.

Coin receptacle 40 is positioned within the confines of sorting drum 24 and includes a plurality of spaced coin receiving hoppers 41 which face in an upward direction and are spaced along the length of sorting drum 24 at distances which correspond to the spacing of the annular rows of coin receiving recesses 25. Coin conduits 12 are connected to coin receiving hoppers 41.

A plurality of proximity sensors or metal detectors 44 are supported by housing 31 and are spaced along the length of the housing at distances corresponding to the spacing of the annular rows of coin receiving recesses 25. When a coin receiving recess 25 carries a coin with it upon the rotation of sorting drum 24, its proximity sensor 44 will detect the presence of the coin. Solenoid controlled air valves are also positioned along the length of sorting drum 24 at intervals corresponding to the spacing of the coin receiving recesses 25. An air valve 45 is located closely adjacent each proximity sensor 44. Thus, when a proximity sensor 44 detects a coin in a recess 25, it actuates its air valve 45. Each air valve is connected to a source of air pressure so that when the air valve is opened by a proximity sensor, it functions to flow a stream of air through its conduit 47 toward the aperture 29 of a coin receiving recess 25.

The arrangement of sorting drum assembly 11 is such that when a mass of coins is fed to the sorting drum 24 through one of its open ends, the rotation of the sorting drum 24 will tend to tumble the coins as the coins fall from the rising portion of the drum under the influence of gravity. The coins tend to fall down the tapered surfaces 30 into the coin receiving recesses 25 of drum 24. If a coin corresponds in diameter to the diameter of outer bore 26 of a recess, it will tend to be seated in the recess. The reduced air pressure in annular air flow chamber 32 tends to hold each coin in a bore 26, if the coin fits the bore. If the coin is smaller than the bore 26, it will tend to slide to the lower portion of the bore 26 as the recess 25 moves up into an upright attitude as the sorting drum 24 rotates, so that the coin does not completely cover inner counter bore 28. The reduced air pressure in annular flow chamber 32 will then cause the stream of air to flow about the edge of the coin and through the aperture 29 behind the coin and the coin will not be held in the recess. As the recess moves beyond an upright attitude and into a generally downwardly facing attitude, the smaller coin will fall from the recess. If the coin is larger than outer bore 26, it will not become seated in the outer bore and when the coin receiving recess 25 moves beyond an upright attitude, the coin will slide out over the tapered surface 30 of the recess and fall back into the mass of coins in sorting drum 24.

Those coins that are properly sized and are received in a recess 25 will pass with its recess toward the upper portion of housing 31. First sector 36 of annular air flow chamber 32 tends to hold or lock the coins in a recess with a light force. As the recesses and seated coins pass baffle means 34, the locking force on the coins is increased because of the increased pressure differential across drum 24 so that the coins will not tend to fall from the recesses as the recesses approach a downward facing attitude.

When a coin passes a proximity sensor 44, it is detected by the proximity sensor and the proximity sensor actuates its solenoid controlled air valve 45, which causes a flow of air through its conduit 47 to impinge the aperture 29 of the coin receiving recess 23, thus breaking the vacuum lock applied to the coin and urging the coin from the recess. This causes the coin to fall from the recess toward coin receptacle 40. Coin receptacle 40 is positioned so that its coin receiving hoppers 41 are located in the normal path of travel of a coin being discharged by an air valve 45. Thus, the coins will fall into a coin receiving hopper 41 and will pass through one of the conduits 12 out of housing 31 and in a downward direction through the conduit. Coins passing through conduits 12 are processed further as described in the aforementioned U.S. Pat. No. 3,707,244.

If the coin passing with a coin receiving recess 25 is bent or has chewing gum stuck to it, or if its surfaces are otherwise malformed or improperly sized, the shape of the coin will prevent the coin from becoming held or locked in a coin receiving recess 25 and the coin will not be lifted toward coin receptacle 40. Moreover, if the coin is a slug, or is fabricated from a metal not compatible with proximity sensors 44, the proximity sensor will not be actuated by the passing of the coin with sorting drum 24 so that the solenoid controlled be ejected or discharged toward receptacle 40.

Figure 4:
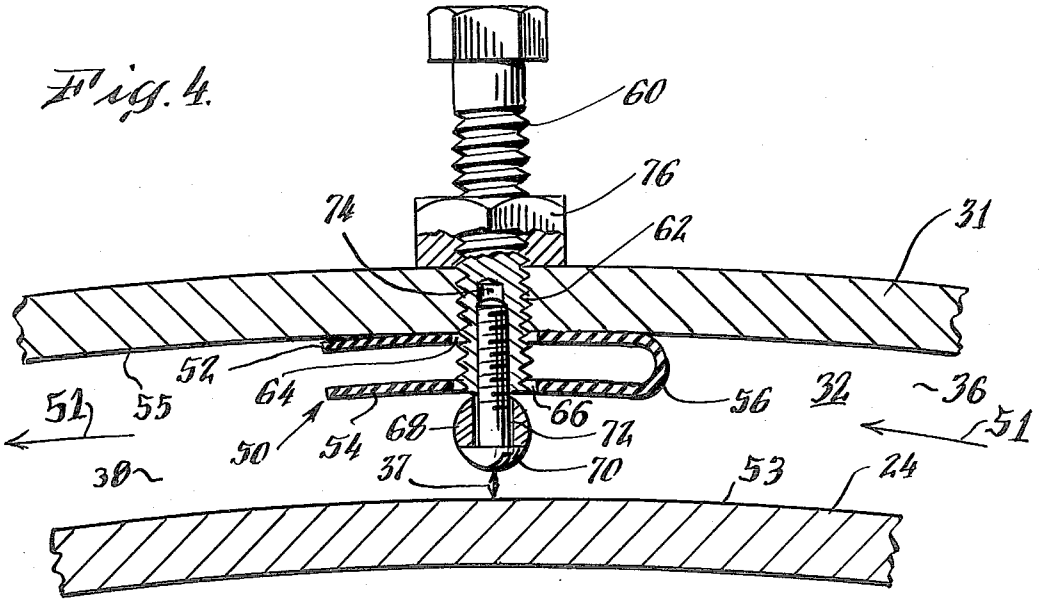
FIG. 4 is an enlarged, fragmentary view taken along line 4—4 of FIG. 3.
Figure 3:
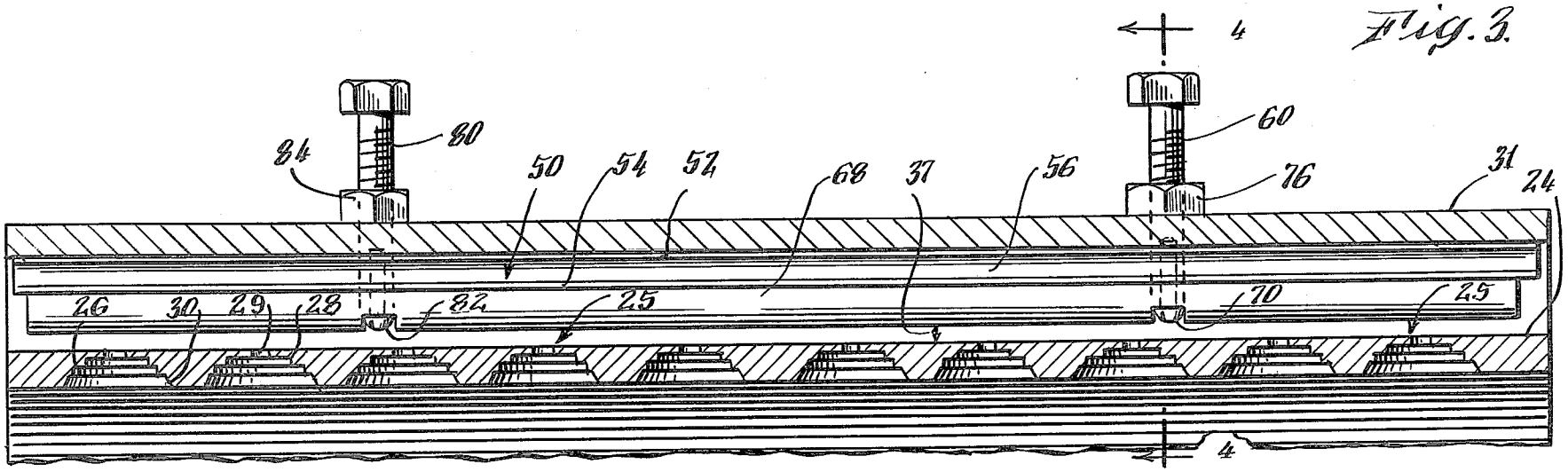
FIG. 3 is an enlarged, fragmentary view taken along line 3—3 of FIG. 2.

FIGS. 3 and 4 illustrate the baffle means 34 in greater detail. Baffle means 35 is similar in detail and the following discussion of baffle means 34 is also descriptive of baffle means 35. The constriction 37 to air flow in the chamber 32, as repre- sented by the arrows 51 in FIG. 4, is provided by the baffle means and a surface 53 of the rotating drum 24. The baffle means has a cross-sectional configuration which can be adjustably varied to expand and thus reduce the size of the constriction 37 thereby increasing the pressure gradiant between the upper sector 38 and lower sector 36 of the chamber 32. Alternatively, the cross-sectional configuration can be adjusted to contract and thus enlarge the size of the constriction thereby reducing the pressure gradiant between these sectors of the chamber. The baffle means includes an elongated resilient baffle body 50 and a means for providing adjustment of the cross-sectional configuration of the baffle body 50 from a location outside of the housing 31. The elongated baffle body 50 is folded in the direction of its width to provide a generally U-shaped configuration as illustrated in FIG. 4. The U-shaped configuration includes first and second integral leg segments 52 and 54 and an integral base segment 56. The first leg segment 52 abuts against and forms an air seal with an inner wall surface 55 of the housing 31. While the first leg segment 52 will remain in contact with the surface 55, the second leg segment 54 can, under influence of the resilience of the body 50, be advanced as described below toward the drum surface 53. The body 50 may be fabricated of various suitable materials. A preferred resilient material comprises commercially available fabric reinforced neoprene rubber.

A means for adjusting the body 50 includes a threaded screw member 60 which engages a threaded aperture 62 in the housing 31 and extends from a location outside the housing 31 to a location within the chamber 32. Screw member 60 also extends through an aperture 64 in the leg segment 52 and through an aperture 66 in the leg segment 54. These apertures are oversized relative to the diameter of the screw member 60 thus enabling the screw member to traverse the apertures without engaging the body 50. An elongated rod 68 extends coextensively with the length of the body 50. It is mounted at one location along its length to the screw 60 by a cap screw 70 which extends through a bore 72 in the rod 68 and egages an internally threaded bore 74 in the screw 60. Rod 68 contacts and engages leg 54 of body 50 along its length. Upon rotation of the screw 60 in its threaded aperture 62 the screw and rod will move transversely through the annular chamber 32. The rod 68 will be advanced or retracted thereby enabling expansion or causing retraction of leg 54 of the body 50. A similar second screw 80 is mounted at a spaced apart longitudinal location in a similar threaded aperture in the housing 31 and extends through apertures in the body 50. The rod 68 is mounted to screw 80 by a cap screw 82. By adjustably rotating the screws 60 and 80, the position of the rod 68 is advanced or retracted as described to thus decrease or increase the size of the constriction 37. Locking nuts 76 and 84 retain the screws 60 and 80, repectively, in their adjusted positions. The cross-sectional configuration of the body 50 will vary accordingly with movement of the rod. The body 50 provides an air seal between the inner surface 55 of the housing 31 and the rod 70 thus establishing the restricted air flow passage in the constriction 37 between the rod 68 and the rotating drum 24.

The adjustable baffle means described enables adjustment of the constriction 37 and thus adjustment of the differential pressure in the upper and lower sectors of the chamber. In particular, the baffle provides an adjustment for establishing desired pressures in the upper and lower chamber sectors to meet particular operating conditions and needs. This facilitates initial set up of the apparatus upon fabrication; it provides for adjustment of pressures resulting from varying conditions with wear, etc.; and, it enables adjustment of pressures to provide for coins of different sizes. Moreover, the provision for adjusting the pressure as described allows locating the baffle means at preferred locations in the apparatus and thus avoids design limitations introduced by prior stationary baffle means.

While there has been described a particular embodiment of the invention, it will be apparent to those skilled in the art that variations may be made thereto without departing from the spirit of the invention and the scope of the appended claims.

What is claimed is:

1. An improved coin sorting arrangement in a coin processing apparatus comprising:

a. a stationary housing;
b. a rotatably mounted sorting drum positioned within said housing for rotation therein;
c. said drum including a plurality of apertures formed therein for receiving and seating coins;
d. means including said drum and housing for forming an annular shaped air chamber between said drum and housing;
e. an elongated baffle means positioned in said chamber;
f. said baffle means extending along a length of said housing and forming with said drum a constriction in said chamber;
g. said baffle means having an adjusted cross-sectional configuration which is expandable to reduce the size of said constriction and is retractable to enlarge the size of said constriction and, means for adjusting the cross-sectional configuration of said baffle means from a location outside of said housing.

2. The arrangment of claim 1 wherein said baffle means includes a resilient, elongated body and said adjusting means extends through said housing and is coupled to said elongated body.

3. The arrangment of claim 2 wherein said resilient body has a generally U-shaped configuration.

4. The arrangement of claim 3 wherein said elongated resilient body is folded into a generally U-shaped configuration having first and second integral leg segments and is maintained in said general U-shaped configuration by said adjusting means.

5. The arrangement of claim 4 wherein said adjusting means includes an elongated rod positioned between said U-shaped resilient body and said drum and extends coextensively with said resilient body, and screw members extending through said housing and through said U-shaped body for engaging said rod and causing traverse movement of said rod in said chamber upon rotation of said screw members.

6. The arrangement of claim 5 wherein said first leg segment engages and forms an air seal with an inner surface of said housing and said second leg segment engages and forms and air seal with said rod.

7. The arrangement of claim 6 wherein said U-shaped body includes apertures formed therein for enabling extension of said screw members through said U-shaped body without engaging said U-shaped body.

8. The arrangement of claim 7 wherein said housing includes threaded apertures postioned at spaced apart locations for engaging said screw members.

9. The arrangement of claim 8 wherein said screw members include threaded bores and said rod is mounted thereto by screw means engaging said rod and said threaded bores.

10. The arrangement of claim 4 wherein said resilient body is formed of neoprene rubber.

* * * * *